US006224482B1

(12) United States Patent
Bennett

(10) Patent No.: US 6,224,482 B1
(45) Date of Patent: May 1, 2001

(54) SLOT MACHINE GAME-PROGRESSIVE JACKPOT WITH DECREMENTING JACKPOT

(75) Inventor: Nicholas Luke Bennett, Sydney (AU)

(73) Assignee: Aristocrat Technologies Australia PTY LTD (AU)

( * ) Notice: Subject to any disclaimer, the term of this patent is extended or adjusted under 35 U.S.C. 154(b) by 0 days.

(21) Appl. No.: 09/150,532

(22) Filed: Sep. 10, 1998

(30) Foreign Application Priority Data

Sep. 10, 1997 (AU) ..... PO9102

(51) Int. Cl.[7] ..... A63B 15/00

(52) U.S. Cl. ..... 463/20; 463/16; 463/17; 463/26; 273/143 R

(58) Field of Search ..... 463/20, 26, 27, 463/16–19, 8; 273/143 R

(56) References Cited

U.S. PATENT DOCUMENTS 4,688,803 * 8/1987 Ollington ..... 273/274
5,275,400 * 1/1994 Weingardt et al. ..... 273/85 CP
5,476,259 * 12/1995 Weingardt ..... 273/85 CP
5,580,053 * 12/1996 Crouch ..... 463/20
5,616,078 * 4/1997 Oh ..... 463/8
5,626,341 * 5/1997 Jones et al. ..... 273/292
5,695,188 * 12/1997 Ishibashi ..... 273/143 R
5,743,800 * 4/1998 Huard et al. ..... 463/26
5,830,063 * 11/1998 Byrne ..... 463/18
5,848,932 * 12/1998 Adams ..... 463/20
5,913,726 * 6/1999 Jones et al. ..... 463/13
5,976,016 * 11/1999 Moody et al. ..... 463/13
5,989,121 * 11/1999 Sakamoto ..... 463/20
5,997,400 * 12/1999 Seelig et al. ..... 463/6

* cited by examiner

*Primary Examiner*—Valencia Martin-Wallace
*Assistant Examiner*—Carmen D. White
(74) *Attorney, Agent, or Firm*—Roseman & Colin LLP

(57) ABSTRACT

A random prize awarding system associated with a gaming console is provided in which the gaming console is arranged to play a first game or a second game, the first game being a standard game normally offered on the console and the second game being a jackpot game offered for play when the player has achieved a trigger condition where the trigger means is arranged to test for the trigger condition and to initiate an instance of the second game when the trigger condition occurs. The second game is divided into a plurality of sub-games, each having an incremental prize such that a sum of the un-won incremental prizes equals the total currently available jackpot prize value of the second game. The player is awarded each sub-game after the first, only if the incremental prize was won in the previous sub-game. The jackpot prize value being decremented by the incremental prize value awarded with the occurrence of each winning sub-game.

40 Claims, 3 Drawing Sheets

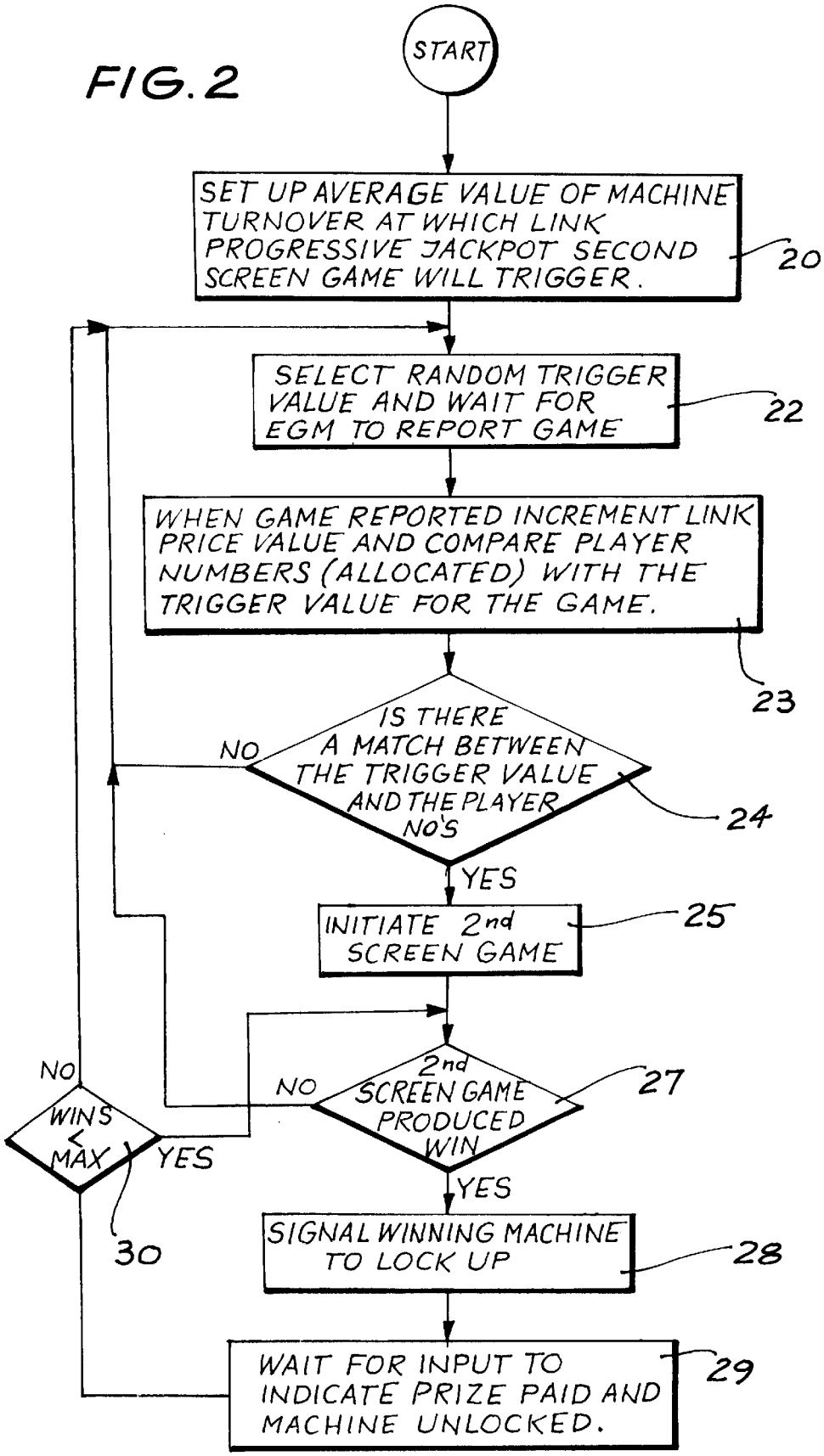
FIG. 2
START
SET UP AVERAGE VALUE OF MACHINE TURNOVER AT WHICH LINK PROGRESSIVE JACKPOT SECOND SCREEN GAME WILL TRIGGER.
20
SELECT RANDOM TRIGGER VALUE AND WAIT FOR EGM TO REPORT GAME
22
WHEN GAME REPORTED INCREMENT LINK PRICE VALUE AND COMPARE PLAYER NUMBERS (ALLOCATED) WITH THE TRIGGER VALUE FOR THE GAME.
23
IS THERE A MATCH BETWEEN THE TRIGGER VALUE AND THE PLAYER NO'S
NO
24
YES
INITIATE 2nd SCREEN GAME
25
2nd SCREEN GAME PRODUCED WIN
NO
27
YES
WINS < MAX
NO
YES
30
SIGNAL WINNING MACHINE TO LOCK UP
28
WAIT FOR INPUT TO INDICATE PRIZE PAID AND MACHINE UNLOCKED.
29

SLOT MACHINE GAME-PROGRESSIVE JACKPOT WITH DECREMENTING JACKPOT

INTRODUCTION

The present invention relates to apparatus for use with a system of linked poker machines and in particular the apparatus provides an improved mystery jackpot mechanism for use with such a poker machine system.

BACKGROUND OF THE INVENTION

Many schemes have been devised in the past to induce players to play slot machines including schemes such as specifying periods during which jackpot prizes are increased or bonus jackpots paid. Other schemes involve awarding an additional prize to a first player to achieve a predetermined combination on a poker machine after a given point in time. These methods, while effective, add to club overheads because of the need for additional staff to ensure that the scheme is operated smoothly. More recently, with the advent of poker machines linked through electrical networks it has been possible to automatically generate jackpot prizes on the basis of information received from the machines being played which are connected to the system and one such prior art arrangement, commonly known as "Cashcade", counts turnover (or games played) on all machines in the network, increments a prize value in accordance with the turnover (or number of games played) and pays a mystery jackpot prize when the count reaches some predetermined and randomly selected number. In a more recent prior art arrangement, each game played on each machine in a gaming system is allocated a randomly selected number and the prize is awarded to a machine when the game number it is allocated matches a preselected random number.

In another recent prior art arrangement, the winning machine is selected by randomly selecting a number at a point in time and decrementing the number as games played on the system are counted until the number is decremented to zero at which time the game (or associated machine) causing the final decrement is awarded the jackpot.

In yet another prior art arrangement, the winning machine is selected using a method weighted towards a particular machine in proportion to its turnover.

Progressive jackpot games have traditionally been popular in Casinos. Their main attraction has undoubtedly been their massive jackpot amounts, which are accessible to players on all gambling budgets. However, in their conventional format these games have obvious limitations:

However, having achieved a trigger condition which awards to a player a bonus game, the player is not assured of winning the jackpot and must first play the associated jackpot game. Many players are discouraged by the relatively small probability of winning a traditional bonus game.

Many of these arrangements have been in use in the State of New South Wales and in other jurisdictions for a considerable period of time, however, as with other aspects of slot machine games, players become bored with such arrangements and new and more innovative schemes become necessary in order to stimulate player interest.

In this specification, the term "combinations" will be used to refer to the mathematical definition of a particular game. That is to say, the combinations of a game are the probabilities of each possible outcome for that game.

SUMMARY OF THE INVENTION

According to a first aspect, the present invention provides a random prize awarding system associated with a gaming console the gaming console being arranged to play a first game or a second game, the first game being a standard game normally offered on the console and the second game being a jackpot game offered for play when the player has achieved a trigger condition, and trigger means arranged to test for the trigger condition and to initiate an instance of the second game when the trigger condition occurs, the second game being divided into a plurality of sub-games, each having an incremental prize such that a sum of the un-won incremental prizes equals a total currently available jackpot prize value of the second game, the player being awarded each sub-game after the first, only if the incremental prize was won in the previous sub-game and the jackpot prize value being decremented by the incremental prize value awarded with the occurrence of each winning sub-game.

According to a second aspect, the present invention provides a method of awarding a random prize associated with one or more gaming consoles, each of the one or more gaming consoles being arranged to play a first game or a second game, the first game being a standard game normally offered on the machine and the second game being a jackpot game offered for play when the player has achieved a trigger condition, the method including testing for a trigger condition and initiating an instance of the second game when the trigger condition occurs, the second game being divided into a plurality of sub-games, each having an incremental prize such that a sum of the un-won incremental prizes equals a total currently available jackpot prize value of the second game, the player being awarded each sub-game after the first, only if the incremental prize was won in the previous sub-game and the jackpot prize value being decremented by the incremental prize value awarded with the occurrence of each winning sub-game.

Preferably, the second game is a simplified game having a higher probability of success than the first game. In a particularly preferred embodiment, the second game provides five reels with four different symbols on each reel and an incremental jackpot is awarded if after spinning the reels a predetermined symbol appears anywhere on the win line. The symbol may or may not be available on each reel or may have multiple instances on particular reels, depending on the size of the incremental prize. In one embodiment, an incremental jackpot of $1000 is paid every time a bird symbol appears on the win line and the player plays until a non-winning game occurs or until he has played ten bonus games whichever is the sooner.

In an alternative embodiment, the jackpot game can be other than a reel game and for example, it could be a turn of the card where the player gambles on colour (red/black) or some other feature. Alternatively, it can be an animated event such as a boxing match where the player gambles on the outcome.

Preferably, the console includes output means arranged to indicate to a central controller each paid game played or each token bet, such that a centrally recorded prize value can be updated by each such event.

Preferably also, the total jackpot prize available to be awarded in a jackpot game by the system of the present invention, is a monetary amount the value of which is incremented with each paid game played or token bet on each gaming machine or console in the system in response to the respective indicative signals. The invention is also applicable to a standalone machine, where all contributions to the jackpot come from the machine on which the jackpot game is played.

The jackpot prize is preferably prominently displayed, in the case of a standalone machine, on the machine display area, and in the case of a system wide jackpot on prominent displays located about the gaming area, as well as optionally on the display of individual machines. As mentioned above, the jackpot prize increments with each game played or token bet on each participating machine, but also decrements with each jackpot sub-game won such that the jackpot value displayed at any one time represents the total amount available to be won at that instant. Decrementing of the prize display will also preferably be accompanied be music or some other sound effect to draw attention to the fact that part of the jackpot has been won and the decrementing should preferably occur by counting down to add drama to the event.

Where used above, the term "console" is used to indicate a gaming machine, a gaming terminal or other device arranged to be connected to a communications system and to provide a user gaming interface. In the following description, examples are give which are applicable to traditional slot machines, however the invention should be taken to include gaming systems which include user interfaces other than traditional slot machines.

BRIEF DESCRIPTION OF THE DRAWINGS

Embodiments of the invention will now be described by way of example, with reference to the accompanying drawings, in which:

FIG. 2 is a flow chart showing a game arrangement according to the invention.

DETAILED DESCRIPTION OF THE PREFERRED EMBODIMENTS

Figure 1:
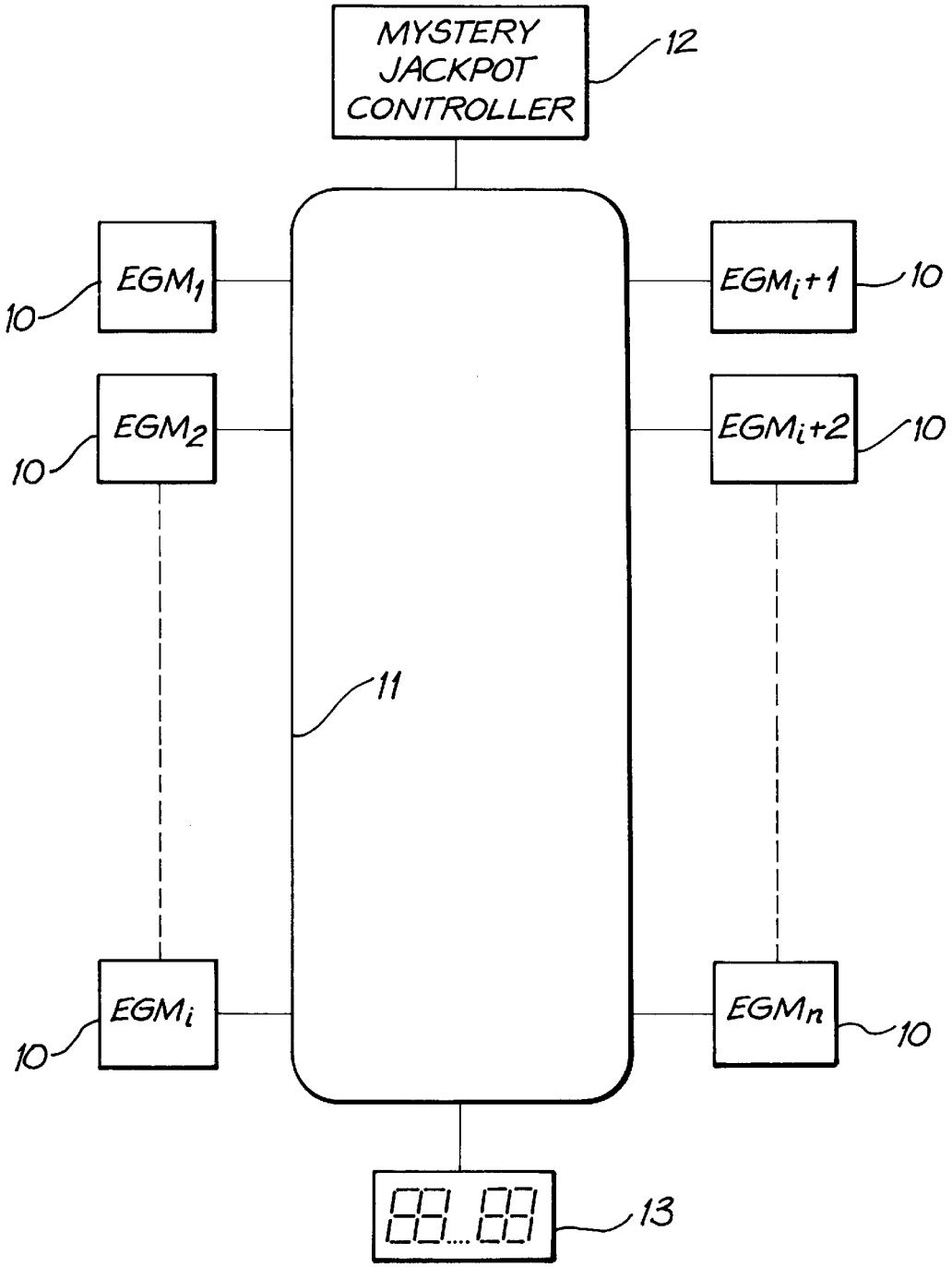
FIG. 1 is a block diagram of a network of electronic gaming machines to which a mystery jackpot controller according to the present invention is connected.

In a preferred embodiment of the invention, a new progressive combination provides the Casino operator with a high degree of flexibility. This Link Progressive System is innovative in it's progressive approach, and intuitively seeks to "adrenalize" the punter. Unlike conventional symbol-based progressive combinations, the jackpots are won from a second screen feature. The second screen feature is preferably triggered randomly as a function of turnover although, other more traditional trigger mechanisms could be employed. When a progressive feature is triggered, a second screen feature game appears. Each progressive jackpot can only be won from this feature game. In one embodiment, a second set of reel strips appears and a simple spin and win feature game commences. When or if a predetermined symbol, such as a bird appears on the win line in the window, then a corresponding incremental progressive jackpot is won. For example, at a particular point in time, the total progressive jackpot may be $10000, but this prize is not paid in one game, but is divided into ten equal prizes of $1000, which are played for in successive sub-games of the jackpot game with the progressive jackpot prize being decremented by the corresponding amount for each win. The player wins a $1000 incremental prize every time he spins the reels and a bird appears on the payline, but, the jackpot game ends with the first sub-game in which an incremental prize is not won. For example, if the player wins in three successive sub-games and then looses, his total prize will be $3000 and the progressive jackpot will then stand at $7000 (subject to further incrementation) available to be won in the next jackpot game awarded.

In an alternative embodiment, instead of providing a spinning reel game as the jackpot game, the jackpot game is an animated feature, such as a boxing match or other similar contest where the player is able to bet on the outcome. When the feature starts, the player is asked to select the outcome that he wishes to gamble on and the animation then commences. In the event that the player wins the gamble he is again asked to select an outcome and the process is repeated. As with the previous embodiment, the jackpot game ends either when a gamble is lost or when a predetermined number of gambles have been completed.

It will be appreciated that other types of gambles such as red/black gambles on the turn of a card are equally applicable to the present invention. Typically, these are rapid jackpots with high increment rates and provide extra incentive to keep player interest on these machines.

Progressive jackpots in this format would have obvious advantages to both player and Casino operator:

(i) Many players play for the small jackpot, believing that the probability of winning larger jackpots is too small to realistically ever occur for them. The present invention encourages such players by providing a greater probability of winning a jackpot while still providing the possibility of winning the big prize. The progressive prize can be divided into as many incremental prizes as the operator thinks desirable.

(ii) Players see the jackpot prize incrementing and decrementing over time and realise that winning the jackpot is achievable.

(iii) The introduction of a feature game which produces what can only be described as the "adrenaline rush"—the gambler's natural high. This psyche has been critical to the success of the most successful prior art games.

(iv) Preferably, when a second screen progressive feature is triggered, a bell sound announces to all of the surrounding players that a possible grand jackpot is about to be played for and is designed so that everyone can share in the experience of a progressive win. The rationale behind this, is that progressive jackpots are only ever seen after the prize has been won. Anecdotal evidence of players watching feature games being played in Australian casinos, suggests the drawing power of such games is very real.

Referring to FIG. 1 a plurality of electronic gaming consoles 10 are connected to a network 11, to which a mystery jackpot controller 12 and display means 13 are also connected.

Each of the electronic gaming consoles 10 are provided with a network interface arranged to provide a signal onto the network 11 on each occurrence of an operation of a respective console and the jackpot controller 12 is arranged to receive each of the console operation signals and to increment the value of a random jackpot prize on the occurrence of each of these operation signals.

A flow chart for a prize awarding algorithm is illustrated in FIG. 2.

Referring to the algorithm of FIG. 2, machine contributions go into the prize pool as with known prior art jackpot systems, while the overhead display shows the incrementing prize value.

In step 20 an average jackpot hit rate value is set to be used to randomly generate trigger data for the link progressive games. This value would typically be set from a preset value programmed by the manufacturer to the specification of the system manager. The actual number range and therefore probability of a link feature game being awarded will depend upon the value of a credit in the particular machine and is calculated by dividing the hit rate value by the value of a credit (eg., $5000/ $0.05=100,000). The average hit rate value may be fixed for the system but may be varied from time to time by the manufacturer at the request of the system manager. For every game that is played, a random trigger value is selected in the range determined from the average hit rate value. The player is also allocated numbers from the source range of numbers that the random number is selected from one number in the range being allocated for each credit bet such that the player's probability of being awarded a second screen game is proportional to the bet. The game is then reported (step 22) to the controller which allocates a contribution to the prize pool and compares the trigger value with the values allocated to the player (step 23), if there is a match between the trigger value and the player values (step 24), the player is given an opportunity to play a second screen jackpot game (step 25) comprising a plurality of sub-games. If a jackpot is awarded (ie, one or more incremental jackpots) as a result of the second screen game, the winning machine is locked up (step 28) and the controller awaits an indication that the total prize has been paid and the machine unlocked (step 29). A test is then preformed (step 30) to determine if the maximum number of second screen games has occurred and if not the machine plays another second screen game (step 27), otherwise the machine returns to commence another main game sequence at step 22.. If the trigger value does not match then there is no link progressive game awarded for that bought game and the controller returns to step 22 and waits for the next console to report operation.

By way of example, a second screen feature game might be triggered by an EGM every $5000 of turnover played, which is equivalent to 100,000 credits on a $0.05 machine. A random number is generated within a prescribed range of numbers at the EGM at the commencement of each bought game. The prescribed range of numbers have been determined previously, having been calculated from the expected casino turnover, expected jackpot amounts and jackpot frequencies. The prescribed range in this example is therefore 1 to 100,000 and before the commencement of each bought game a random number is generated within this range. A bet of 20 credits will include or "cover" the numbers between 1 and 20 (inclusive). In this case, the number 7 is produced by the random number generator, then the second screen feature game will be triggered. If any number between 21 and 100,000 is produced by the random number generator, the second screen feature game will not be triggered. Similarly, a bet of 200 credits will include or cover the numbers between 1 and 200 (inclusive). If any number between 1 and 200 is produced by the random number generator, then the second screen feature game will be triggered. If any number between 201 and 100,000 is produced by the random number generator, the second screen feature game will not be triggered.

The example below has been developed using hypothetical turnover data. A trigger of the second screen feature game is expected every $5884.22 of turnover (ie, 117684 credits on a $0.05 machine). Increasing the number of credits bet increases the chance of triggering the feature on any bought game.

| Number of credits bet | Range numbers assigned | Games to hit | Bet/game | Turnover of EGM since last hit ($) |
|---|---|---|---|---|
| 1 | 1 to 1 | 117684.42 | $0.05 | $5884.22 |
| 2 | 1 to 2 | 58842.21 | $0.10 | $5884.22 |
| 3 | 1 to 3 | 39228.14 | $0.15 | $5884.22 |
| 5 | 1 to 5 | 23536.88 | $0.25 | $5884.22 |
| 10 | 1 to 10 | 11768.44 | $0.50 | $5884.22 |
| 15 | 1 to 15 | 7845.63 | $0.75 | $5884.22 |
| 20 | 1 to 20 | 5884.22 | $1.00 | $5884.22 |
| 25 | 1 to 25 | 4707.38 | $1.25 | $5884.22 |
| 30 | 1 to 30 | 3922.82 | $1.50 | $5884.22 |
| 40 | 1 to 40 | 2942.11 | $2.00 | $5884.22 |
| 45 | 1 to 45 | 2615.21 | $2.25 | $5884.22 |
| 50 | 1 to 50 | 2353.69 | $2.50 | $5884.22 |
| 60 | 1 to 60 | 1961.41 | $3.00 | $5884.22 |
| 75 | 1 to 75 | 1569.13 | $3.75 | $5884.22 |
| 100 | 1 to 100 | 1176.84 | $5.00 | $5884.22 |
| 150 | 1 to 150 | 784.56 | $7.50 | $5884.22 |
| 200 | 1 to 200 | 588.42 | $10.00 | $5884.22 |

A jackpot bell set to a default maximum volume level (ie setting 15) will signal the triggering of a second feature game. The jackpot bell should last for a maximum of 3 seconds. Players are alerted by the jackpot bell instantaneously at any point during a game, but the second screen feature game will not appear until the current game (including base game features) are completed.

Figure 3:
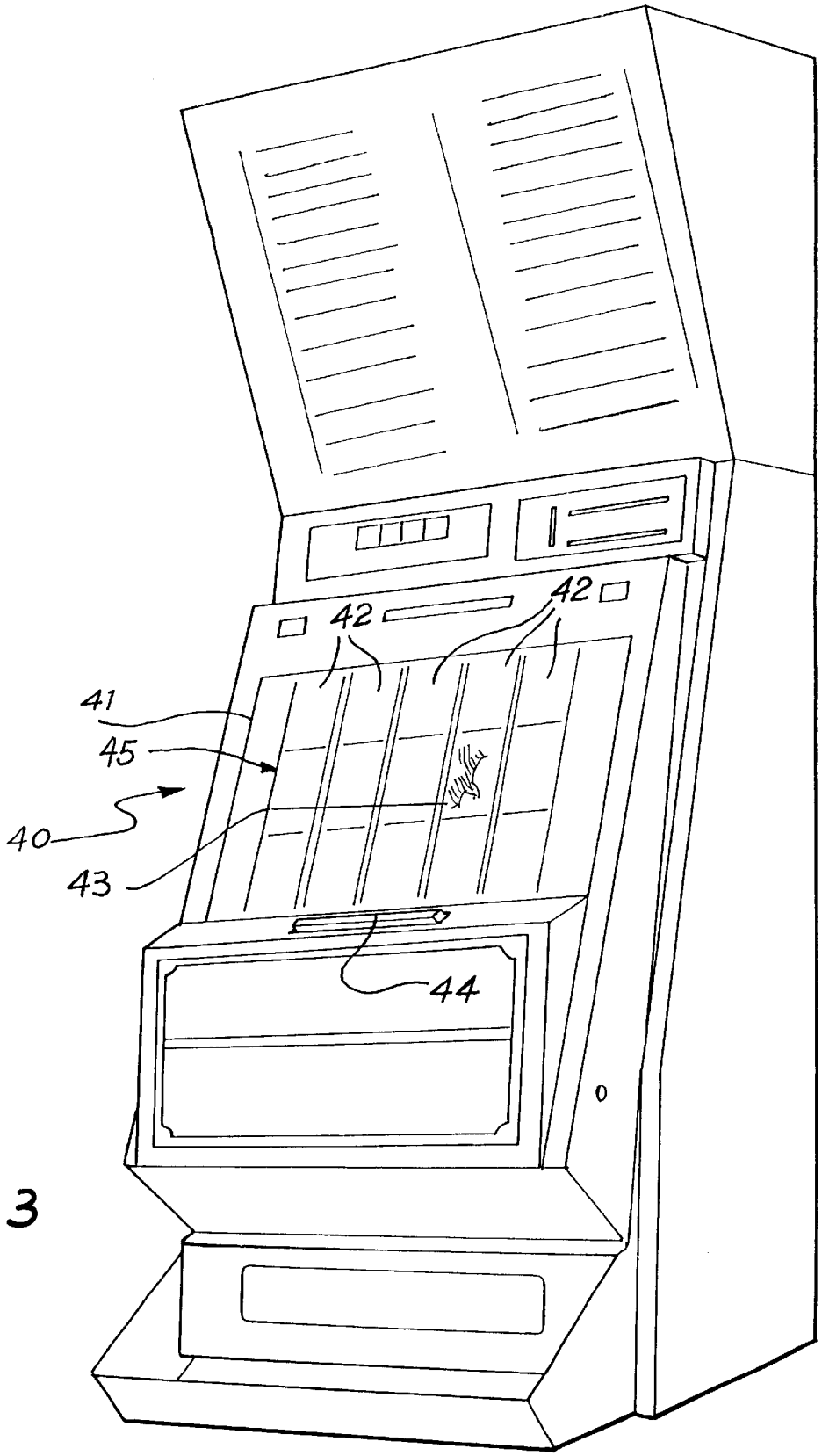
FIG. 3 shows an example of a 5 reel by 3 line window display.

Referring to FIG. 3, one possible second screen game that can be provided on the slot machine 40 embodying the present invention provides five simulated rotatable reels 42 displayed on a video display 41. When the feature begins, the reels are displayed in a stationary position with a random non-winning pattern of symbols displayed. The player is then invited to press the play button 44 to commence a jackpot sub-game and when pressed, the reels will spin and stop. In the event that any one of the reels displays a bird symbol 43 on the payline the player will be awarded an incremental jackpot prize the total jackpot value available will be decremented by an equivalent amount and the player will be invited to play again. The player will continue to be invited to play until either a non-winning game is played (ie, no bird on the centre line) or until a predetermined maximum number of jackpot sub-games have been played. For example, the player might be offered a maximum of ten sub-games with the total jackpot prize divided into ten incremental prizes. Alternatively, other divisions can be employed. The division can be made on the basis of fixed value incremental prizes or the division value can be fixed and the incremental prizes varied in proportion to the value of the total jackpot. In some embodiments, only part of the total jackpot prize might be allocated to a particular jackpot game (eg; a half of the total or some fixed value such as $10,000).

Each time a player wins an incremental prize, a bell or other audible signal will sound to draw attention to the win and other players around the gaming area will see the total jackpot prize decrementing on distributed jackpot value displays. Preferably, this will be achieved by counting down in a suitable increment to add to the drama of the event. Preferably, the signal will increase in pitch, sound level or duration, of a combination of these features as the incremental prizes add up, to add excitement to the game.

Each sub-game will have a relatively high probability of a win occurring and might, for example, have a probability of 1 in 2 chances, the probability being determined by the number of winning symbols placed on each reel strip.

The instant the second feature game is completed and the sum of the prizes from all of the sub-games have been calculated, the progressive jackpot sign will display the total jackpot that has been won, as well as the jackpot value still available to be won by others. This celebration of the jackpot win is typically conducted in a traditional manner (ie flashing displays, jackpot alarms, music etc). In preferred embodiments the progressive total jackpot will also be displayed as the sub-games are completed.

The expected jackpots for each progressive are turnover dependent. The jackpot frequencies are arbitrarily set to satisfy the specific needs of each casino. Therefore, both expected jackpot and jackpot frequency are installation specific and of course will change from casino to casino.

As the time between jackpot game awards is related to turnover, the number of jackpot games played by a player and hence their chance of winning is directly related to the size of each bet on each game played.

(1) All machines on the link have a 2nd screen game, be it an animation game or a second set of reel strips.

(2) Second screen games provided on various machines in the system can be a mixture of incremental jackpot games according to the present invention and other styles of games, thereby giving the player a choice as to the style of game played.

(3) The link has a number of progressive meters (up to 8). All progressives may be linked.

(4) The second screen game is activated when a machine has reached a predetermined dollar turnover. This is only known to the machine or a controller. For example, the second screen is activated when (an average of) $150 has been turned over. This means that whenever $0 to $300 has been turned over, the second screen appears. The benefit of activating the second screen on turnover enables mixed denomination on the link for the first time. The second screen gives the player the chance of winning one of the 4 progressives if a certain outcome appears. For example, a new set of reel strips appear with only 4 different symbols: Jackpot 1, Jackpot 2, Jackpot 3, Jackpot 4. The first time 5 of the same appear on the centre line the stated progressive is won.

(5) Another advantage of awarding a progressive prize won in a second screen, is that it can be applied to any game.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A random prize awarding system comprising: a gaming console the gaming console being arranged to play a first game and a second game, the first game being a standard game normally offered on the console and the second game being a jackpot game offered for play when a player has achieved a trigger condition, and trigger means arranged to test for the trigger condition and to initiate an instance of the second game when the trigger condition occurs, the second game being divided into a plurality of sub-games, each sub-game when played, producing a sub-game outcome selected from a plurality of possible sub-game outcomes and at least one possible sub-game outcome of each sub-game having an incremental prize such that a sum of un-won incremental prizes of the second game associated with it, equals a total currently available jackpot prize value of the second game, the player being awarded each sub-game after the first, only if the incremental prize was won in a previous sub-game and the jackpot prize value being decremented by the incremental prize value awarded with an occurrence of each prize winning sub-game.

2. The prize awarding system of claim 1, wherein the second game is a simplified game having a higher probability of success than the first game.

3. The prize awarding system of claim 2, wherein the second game is of the spinning reel type in which a plurality of reels or pseudo reels is provided with 2–8 different symbols on each reel and an incremental jackpot is awarded if after spinning the reels a predetermined symbol appears anywhere on a win line.

4. The prize awarding system of claim 3, wherein the second game provides five reels with four different symbols on each reel and an incremental jackpot is awarded if after spinning the reels a predetermined symbol appears anywhere on the win line.

5. The prize awarding system of claim 3, wherein at least one instance of the predetermined symbol is available on each reel or pseudo reel of the gaming console.

6. The prize awarding system of claim 3, wherein the predetermined symbol is not available on at least one reel or pseudo reel of the gaming console.

7. The prize awarding system as claimed in claim 3, wherein multiple instances of the predetermined symbol occur on one reel of the gaming machine.

8. The prize awarding system of claim 1, wherein an incremental jackpot of a predetermined value is paid every time a predetermined symbol appears on a win line.

9. The prize awarding system of claim 8, wherein after the trigger condition occurs a series of jackpot sub-games is provided, the jackpot sub-games being provided until a non-winning jackpot game occurs or until a predetermined maximum number of jackpot sub-games have been played.

10. The prize awarding system as claimed in claim 1, wherein the jackpot game does not employ spinning reels or pseudo spinning reels.

11. The prize awarding system as described in claim 10, wherein jackpot sub-games each have a 2-state outcome.

12. The prize awarding system as claimed in claim 11, wherein the jackpot sub-games each display an animated boxing tournament in which the player is offered a choice between two competing boxers and the prize is awarded if the player correctly predicts a winning outcome.

13. The prize awarding system of claim 11, wherein the jackpot sub-game relies on a prediction of a colour of a card dealt to the player.

14. The prize awarding system of claim 11, wherein the jackpot sub-game relies on the spin of a pseudo coin.

15. The prize awarding system as claimed in claim 1, wherein the console includes output means arranged to output a signal to a central controller for each paid game played or each token bet, a central register being updated by each such event to represent an incrementing prize value.

16. The prize awarding system as claimed in claim 15, wherein the system operates over a plurality of inter-connected gaming machines and the total jackpot prize available to be awarded in the jackpot game provided on any machine in the system is a monetary amount having a value which is incremented with each paid game played or token bet on each gaming console in the system of inter-connected machines in response to respective output signals.

17. The prize awarding system as claimed in claim 16, wherein a current total jackpot prize value is displayed.

18. The prize awarding system as claimed in claim 1, wherein a current total jackpot value is displayed on a display area of the console on a prominent display located in a gaming area.

19. The prize awarding system as claimed in claim 17, wherein decrementing of the prize display is accompanied by a sound effect.

20. The prize awarding system as claimed in claim 19, wherein the decrementing is displayed by counting down from an original value to a decremented value.

21. A method of awarding a random prize comprising one or more gaming consoles, each of the one or more gaming consoles being arranged to play a first game and second game, the first game being a standard game normally offered on the gaming console and the second game being a jackpot game offered for play when a player has achieved a trigger condition, the method including testing for a trigger condition and initiating an instance of the second game when the trigger condition occurs, the second game being divided into a plurality of sub-games, each sub-game when played, producing a sub-game outcome selected from a plurality of possible sub-game outcomes and at least one possible sub-game outcome of each sub-game having an incremental prize of the second game associated with it, such that a sum of un-won incremental prizes equals a total currently available jackpot prize value of the second game, the player being awarded each sub-game after a first sub-game, only if the incremental prize was won in a previous sub-game and the jackpot prize value being decremented by the incremental prize value awarded with an occurrence of each prize winning sub-game.

22. The method of claim 21, wherein the second game is a simplified game having a higher probability of success than the first game.

23. The method of claim 22, wherein the second game is of a spinning reel type with in which a plurality of reels or pseudo reels is provided with 2–8 different symbols on each reel and an incremental jackpot is awarded if after spinning the reels a predetermined symbol appears anywhere on a win line.

24. The method of claim 23, wherein the second game provides five reels with four different symbols on each reel and an incremental jackpot is awarded if after spinning the reels a predetermined symbol appears anywhere on the win line.

25. The method of claim 24, wherein at least one instance of a trigger symbol is available on each reel or pseudo reel of the gaming console.

26. The method of claim 23, wherein the predetermined symbol is not available on at least one reel or pseudo reel of the gaming console.

27. The method as claimed in claim 23, wherein multiple instances of the predetermined symbol occur on one reel of the gaming console.

28. The method as claimed in claim 21, wherein an incremental jackpot of a predetermined value is paid every time a predetermined symbol appears on a win line.

29. The method of claim 28, wherein after the trigger condition occurs a series of jackpot sub-games is provided, the jackpot sub-games being provided until a non-winning jackpot game occurs or until a predetermined maximum number of jackpot sub-games have been played.

30. The method as claimed in claim 21, wherein the jackpot game does not employ spinning reels or pseudo spinning reels.

31. The method as described in claim 30, wherein jackpot sub-games each have a 2 state outcome.

32. The method as claimed in claim 31, wherein the jackpot sub-games each display an animated boxing tournament in which the player is offered a choice between two competing boxers and the prize is awarded if the player correctly predicts the winning outcome.

33. The method of claim 32, wherein the jackpot sub-game relies on the prediction of a colour of a card dealt to the player.

34. The method of claim 33, where the jackpot sub-game relies on the spin of a pseudo coin.

35. The method as claimed in claim 21, wherein the console includes output means arranged to output a signal to a central controller for each paid game played or each token bet, a central register being updated by each such event to represent an incrementing prize value.

36. The method as claimed in claim 35, wherein the system operates over a plurality of inter-connected gaming machines and a total jackpot prize available to be awarded in a jackpot game provided on any machine in the system is a monetary amount having a value which is incremented with each paid game played or token bet on each gaming console in the system of inter-connected machines in response to respective output signals.

37. The method as claimed in claim 36, wherein a current total jackpot prize value is displayed.

38. The method as claimed in claim 21, wherein a current total jackpot value is displayed on a display area of the console on a prominent display located in a gaming area.

39. The method as claimed in claim 38, wherein decrementing of the prize value on the display is accompanied by a sound effect.

40. The method as claimed in claim 39, wherein the decrementing is displayed by counting down from an original value to a decremented value.

* * * * *